US009928668B2

(12) United States Patent
Oda et al.

(10) Patent No.: US 9,928,668 B2
(45) Date of Patent: Mar. 27, 2018

(54) ELECTRONIC CONTROL DEVICE AND ELECTRONIC CONTROL SYSTEM

(71) Applicant: DENSO CORPORATION, Kariya, Aichi-pref. (JP)

(72) Inventors: Shinichiro Oda, Kariya (JP); Hiroyuki Enomoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 29 days.

(21) Appl. No.: 15/003,937

(22) Filed: Jan. 22, 2016

(65) Prior Publication Data

US 2016/0225196 A1 Aug. 4, 2016

(30) Foreign Application Priority Data

Jan. 29, 2015 (JP) ..... 2015-015859

(51) Int. Cl.
*G07C 5/00* (2006.01)
*G07C 5/08* (2006.01)

(52) U.S. Cl.
CPC ..... *G07C 5/008* (2013.01); *G07C 2205/02* (2013.01)

(58) Field of Classification Search
CPC ..... G07C 5/008; G07C 2205/02
See application file for complete search history.

(56) References Cited

U.S. PATENT DOCUMENTS 5,038,289 A 8/1991 Abe
5,200,745 A 4/1993 Takai et al.
6,285,931 B1 * 9/2001 Hattori ..... G07C 5/008 340/426.15
2001/0037168 A1 11/2001 Hozuka et al.
2006/0259209 A1 11/2006 Sugimura
2008/0161989 A1 7/2008 Breed
2008/0180676 A1 * 7/2008 Tsai ..... G06F 1/26 356/437
2008/0284575 A1 11/2008 Breed
(Continued)

FOREIGN PATENT DOCUMENTS

JP H04-21945 U 2/1992
JP H07-046676 A 2/1995
(Continued)

OTHER PUBLICATIONS

U.S. Appl. No. 15/003,971, filed Jan. 22, 2016, Oda et al.

*Primary Examiner* — Anne M Antonucci
(74) *Attorney, Agent, or Firm* — Posz Law Group, PLC

(57) ABSTRACT

An electronic control device (ECU) reserves a transmission of a requested diagnosis data that is requested by a management center when an external device is connected to a dedicated connector, and when IGSW is turned ON. In such scheme, a delay of an off-board diagnosis process in the ECU is prevented when a diagnosis tool connected to the dedicated connector performs an off-board diagnosis. Further, after turning OFF of IGSW, the ECU, which is no longer due for a request from the external device connected to the dedicated connector, transmits the requested diagnosis data to the center, enabling the center to perform a remote diagnosis service. Therefore, the remote diagnosis service is performable when a commercially-available external device is connected to the dedicated connector by a user of a vehicle.

8 Claims, 6 Drawing Sheets

(56) References Cited

U.S. PATENT DOCUMENTS

| | | | | |
|---|---|---|---|---|
| 2011/0093159 | A1* | 4/2011 | Boling | G06Q 10/06 701/29.6 |
| 2013/0345903 | A1* | 12/2013 | Nakagawa | G07C 5/008 701/2 |
| 2014/0052531 | A1 | 2/2014 | Kent et al. | |
| 2016/0225197 | A1 | 8/2016 | Oda et al. | |

FOREIGN PATENT DOCUMENTS

| | | | |
|---|---|---|---|
| JP | H09-021866 | A | 1/1997 |
| JP | H09-210866 | A | 8/1997 |

* cited by examiner

ELECTRONIC CONTROL DEVICE AND ELECTRONIC CONTROL SYSTEM

CROSS REFERENCE TO RELATED APPLICATION

The present application is based on and claims the benefit of priority of Japanese Patent Application No. 2015-015859, filed on Jan. 29, 2015, the disclosure of which is incorporated herein by reference.

TECHNICAL FIELD

The present disclosure generally relates to an electronic control device disposed in a vehicle and having an off-board diagnosis function that is performed in response to a request from an external diagnosis device, and an electronic control system having such an electronic control device.

BACKGROUND INFORMATION

Conventionally, as disclosed in a Japanese Patent Laid-Open No. H07-46676 (patent document 1), an electronic control device installed in a vehicle, or an in-vehicle Electronic Control Unit (ECU) performs, in cooperation with an external diagnosis device (i.e., a so-called diagnosis tool), an off-board diagnosis of a vehicle, in response to a request from the external diagnosis device. In such an off-board diagnosis, a read-out instruction is sent from the diagnosis tool to the in-vehicle ECU to read out various failure diagnosis data including a result of an on-board diagnosis, or to control the vehicle devices for various operations that are not usually performed, in order to perform a high-level diagnosis.

Further, in recent years, vehicle manufactures sometimes provide a remote diagnosis service for the vehicle user. The remote diagnosis service may, for example, collect data such as a travel distance, a failure diagnosis data, warning information, and the like from each vehicle to send to a management center via a data communication, and may send a notice to the user based on the collected data that it is time for the vehicle to have a regular checkup in a service shop, for example.

When the off-board diagnosis is performed in response to a request from the diagnosis tool, the diagnosis tool is connected to a dedicated connector, and the request is sent in a message form to the in-vehicle ECU via a dedicated connector. The in-vehicle ECU sends back a response message to the diagnosis tool within a preset period of time, after receiving a request message. The diagnosis tool determines that an abnormality is being caused regarding a communication with the in-vehicle ECU, if the tool does not receive the response message within the preset period of time.

Therefore, to provide the remote diagnosis service described above, a special care is required to not delay a process of the off-board diagnosis that is performed based on the request from the diagnosis tool. Therefore, to prevent such a delay, when the diagnosis tool is connected to the dedicated connector, the in-vehicle ECU may be configured not to perform a process about the remote diagnosis service.

However, a publicly-sold display device is connectable to the dedicated connector for reading various kinds of vehicle information (e.g., for reading a fuel mileage, an average speed, water temperature etc.,) and the user can purchase such a device in an aftermarket. The display device is, in principle, connected to the dedicated connector all the time, for the reading of the vehicle information. On the in-vehicle ECU side, it is difficult to distinguish whether the connector is connected to the diagnosis tool or to the display device. Therefore, if the in-vehicle ECU is configured not to perform the process about the remote diagnosis service when an external device is connected to the dedicated connector, the data required for the remote diagnosis service is not transferable from the vehicle to the management center when the user connects the above-described display device to the dedicated connector.

SUMMARY

It is an object of the present disclosure to provide an ECU that is capable of transmitting required data for a remote diagnosis service even when a vehicle user connects a publicly-sold (i.e., commercial) external tool to a dedicated connector, and an electronic control system having such an ECU.

In an aspect of the present disclosure, an electronic control device installed in a vehicle for performing a predetermined control process, includes an off-board diagnoser performing an off-board diagnosis in response to a request from an external device that is connected to a dedicated connector providing a connection to the external device. The electronic control device also includes a requested diagnosis data transmission unit (i) generating a diagnosis data when receiving, from an external management center, a transmission request that requests a transmission of the diagnosis data, and (ii) transmitting the diagnosis data to the external management center. The requested diagnosis data transmission unit is configured to (a) reserve the transmission of the diagnosis data in response to the transmission request from the external management center, when receiving the transmission request in a state that (A) the external device is connected to the connector and (B) an ignition switch of the vehicle is in a turned ON state, and (b) perform the transmission of the diagnosis data after a turning OFF of the ignition switch of the vehicle.

According to the electronic control device, or ECU, of the present disclosure, when the external device is connected to the connector, and when the ignition switch is in a turned ON state, the diagnosis data is not transmitted to the management center, even when a transmission request from the center is received. Therefore, during a period in which the diagnosis tool is connected to the connector, and the off-board diagnosis is performed, a delay of the off-board diagnosis is prevented from happening. Further, after a turning OFF of the ignition switch, the ECU does not have to respond to a request from the external device that is connected to the connector. Therefore, the ECU performs a requested transmission of the diagnosis data. In such manner, data required for the remote diagnosis service is transmitted to the management center.

Further, in another aspect of the present disclosure, an electronic control system including an electronic control device installed in a vehicle for performing a predetermined control process includes an off-board diagnoser performing an off-board diagnosis in response to a request from an external device that is connected to a dedicated connector providing a connection to an external device, a communicator communicating with an external management center, and a requested diagnosis data transmission unit (i) generating a diagnosis data when receiving, from the external management center, a transmission request that requests a transmission of the diagnosis data, and (ii) transmitting the diagnosis data to the external management center by using the communicator. The requested diagnosis data transmission unit is configured to (a) reserve the transmission of the diagnosis data in response to the transmission request from the external management center, when receiving the transmission request in a state that (A) the external device is connected to the connector and (B) an ignition switch of the vehicle is in a turned ON state, and (b) perform the transmission of the diagnosis data after a turning OFF of the ignition switch of the vehicle.

According to the electronic control system of the present disclosure configured in the above-described manner, the same effects as the above-mentioned ECU are achieved.

The numerals in the above are intended to exemplify a relationship between the claimed elements and the configuration in the embodiment, and not restricting the scope of the disclosure in any manner.

Further, other technical features in each of the claims other than one described above may become apparent based on the description of the embodiments and based on the attached drawings.

BRIEF DESCRIPTION OF THE DRAWINGS

Objects, features, and advantages of the present disclosure will become more apparent from the following detailed description made with reference to the accompanying drawings, in which.

DETAILED DESCRIPTION

First Embodiment

Hereafter, the first embodiment of present disclosure is described based on the drawings.

Figure 1:
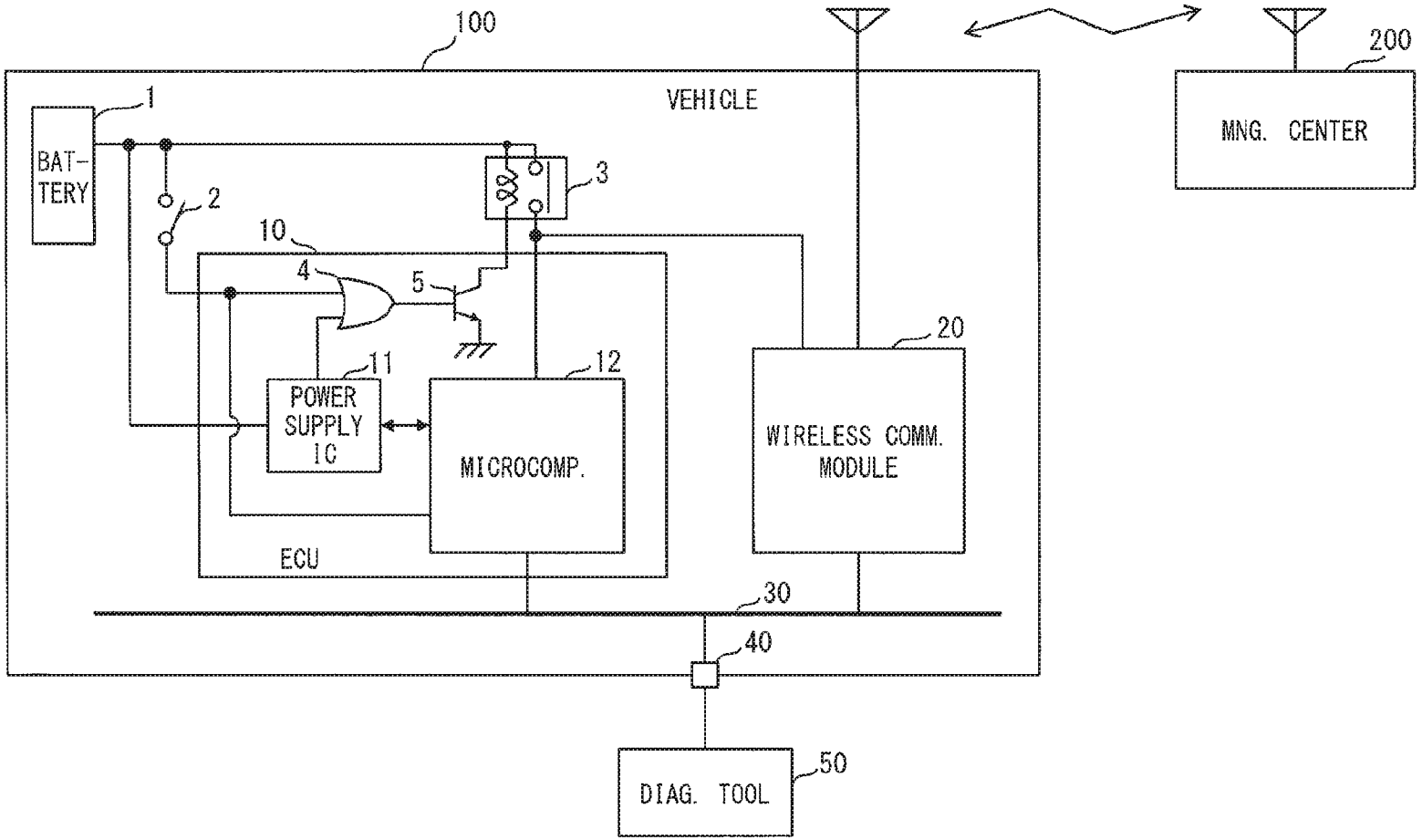
FIG. 1 is a block diagram of a configuration of an electronic control system in a first embodiment of the present disclosure.

FIG. 1 is a block diagram of a configuration of an electronic control system concerning the present embodiment.

The electronic control system of the present embodiment has an electrical control device (ECU) 10 and a wireless communication module 20.

ECU 10 and the communication module 20 are disposed on a vehicle 100, for example, and are mutually connected via a communication bus 30 of an in-vehicle network which operates based on a communications protocol, such as a Controller Area Network (CAN). Therefore, ECU 10 and the communication module 20 are mutually communicable via the communication bus 30.

A dedicated connector 40, which is capable of providing a connection to the external devices (e.g., a diagnosis tool 50), is connected to the communication bus 30. The dedicated connector 40 is disposed at a lower part of a dashboard around the driver's seat, for example. When the diagnosis tool 50 is connected to the dedicated connector 40, the diagnosis tool 50 becomes communicable with ECU 10 via the communication bus 30 and the dedicated connector 40. Although not illustrated, the dedicated connector 40 has a mechanical switch for detecting that an external device including the diagnosis tool 50 is connected to the dedicated connector 40.

The wireless communication module 20 is capable of performing communication with an external management center 200 by wireless communication, which uses a portable telephone network, for example. An example of communication between the wireless communication module 20 and the management center 200 is described below.

First, the wireless communication module 20 receives a request from management center 200, which request a transmission of diagnosis data. In this case, the wireless communication module 20 outputs a received request to transmit the diagnosis data to ECU 10. According to the transmission request, ECU 10 generates the requested diagnosis data. The generated diagnosis data is outputted to the wireless communication module 20. The wireless communication module 20 transmits the diagnosis data to the management center 200, upon receiving the diagnosis data from ECU 10.

Thereby, the management center 200 obtains various kinds of vehicle information (e.g., a travel distance, data for failure diagnoses, warning information, etc.) as the diagnosis data. Further, for example, based on the obtained vehicle information, the management center 200 determines a suitable maintenance timing of a corresponding vehicle, and notifies the vehicle user of the maintenance timing.

The maintenance timing notice may be provided by using the wireless communication module 20, or may be transmitted to the user's cellular phone (e.g., to a smart phone), a personal computer, etc. in the form of an e-mail.

In the electronic control system including ECU 10, the diagnosis tool 50 is used for performing an off-board diagnosis. ECU 10 has a self-diagnosis function for determining whether the ECU 10 itself and its peripheral circuit, as well as sensors and actuators, are normally operating based on an execution of a built-in software, and for recording the diagnosis results and related data (i.e., failure diagnosis data), which may also be designated as an on-board diagnosis function. The off-board diagnosis is performed as (i) a read-out and a transmission of the failure diagnosis data derived from the on-board diagnosis and (ii) a special operation of a control object device or the like performed for a high-level diagnosis, together with a transmission of resulting data of such special operation.

Therefore, the diagnosis tool 50 transmits to ECU 10 a request message that requests a read-out of the failure diagnosis data, and an execution of a special operation. Then, according to the request message, ECU 10 reads the failure diagnosis data, and detects operation-related data regarding the special operation. Then, ECU 10 transmits the response message that includes the data, and proof of an execution of the requested diagnosis operation to the diagnosis tool 50.

The diagnosis tool 50 measures a lapse time after a transmission of the request message until it receives the response message. When the measured lapse time reaches a preset value without receiving the response message, the diagnosis tool 50 determines that a certain abnormality is caused in communication with ECU 10, for example. Therefore, ECU 10 is required to transmit the response message in response to the request message within a predetermined time after receiving the request message.

ECU 10 is provided with a power supply IC 11 and a microcomputer 12.

The power supply IC 11 is an Integrated Chip (IC) for controlling a state of a power relay 3 which provides a power supply to ECU 10 and to the wireless communication module 20.

The microcomputer 12 has a well-known configuration including Central Processing Unit (CPU), memories (e.g., Read Only Memory (ROM), Random Access Memory (RAM), Electrically Erasable Programmable Read-Only Memory (EEPROM), etc.), a communication interface, a bus line that connects the above elements. In addition, the microcomputer 12 is configured to perform, besides performing predetermined control processes, (i) an off-board diagnosis process based on the request message from the diagnosis tool 50, and (ii) a generation process and a transmission process of the diagnosis data based on a request from the management center.

Further, the microcomputer 12 is electrically connected to a battery 1 disposed in the vehicle 100 via an ignition switch (IGSW) 2. Therefore, an ignition (IG) signal that shows an ON and OFF of IGSW 2 is inputted to the microcomputer 12. Based on the IG signal, the microcomputer 12 can detect whether IGSW 2 is ON or OFF.

The power supply IC 11 always receives a power supply from the battery 1, and the power supply IC 11 is operable even when IGSW 2 is turned OFF. However, the power supply to the power supply IC 11 may be provided from the power relay 3 that is mentioned later.

The output signal of the power supply IC 11 is inputted to an OR circuit 4. Also, an IG signal is inputted to the OR circuit 4 via IGSW 2. Further, an output of the OR circuit 4 is connected to a base of a transistor 5 that is connected to a coil of the power relay 3. Therefore, when a high-level signal is outputted from the OR circuit 4, the transistor 5 is turned ON. Then, an electric current flows to the coil of the relay 3, and a contact of the relay 3 is turned ON. On the other hand, when a low-level signal is outputted from the OR circuit 4, the transistor 5 is turned OFF. Therefore, the power supply to the coil of the relay 3 stops, and the contact of the relay 3 is turned OFF.

In the example shown in FIG. 1, although the OR circuit 4 and the transistor 5 are disposed in an inside of ECU 10, these components may also be disposed at an outside of ECU 10.

Here, the power supply to ECU 10 and to the communication module 20 is described.

First, when IGSW 2 is turned ON, an IG signal is input to the OR circuit 4. According to the input of the IG signal, the OR circuit 4 outputs a high-level signal. Therefore, the contact of the relay 3 is turned ON and the power supply to ECU 10 and to the communication module 20 is started.

When the power supply to ECU 10 is started, the microcomputer 12 instructs the power supply IC 11 to output a high-level signal. Thereby even when IGSW 2 is turned off, the OR circuit 4 maintains (i.e., keeps on outputting) the high-level signal, which prevents an immediate shut-down of the power supply to ECU 10 and to the communication module 20 immediately after a turning OFF of IGSW 2.

When the microcomputer 12 detects that IGSW 2 is turned OFF based on an input of the IG signal, the microcomputer 12 instructs the power supply IC 11 to output the low-level signal after a preset time from such detection. Based on such instruction, the power supply IC 11 starts time measurement, and after the lapse of the preset time, the IC 11 switches the output signal from the high level to the low level. Therefore, after a turning OFF of IGSW 2, the power supply is maintained (i.e., is kept uninterrupted) for the preset time, and ECU 10 and the communication module 20 are kept in an operable state. Further, the length of the predetermined time mentioned above is pre-defined as a period of time that is longer than a maximum time required of an operation which may possibly be performed by ECU 10 or the communication module 20 after a turning OFF of IGSW 2.

In the electronic control system having the above-described configuration, when the diagnosis tool 50 is connected to the dedicated connector 40, the microcomputer 12 receives the request message from the diagnosis tool 50. After receiving the request message, the microcomputer 12 is required to transmit, without delay, the response message based on performing the requested diagnosis operation and/or preparing the required data. Therefore, when the external device is connected to the dedicated connector 40, the electronic control system concerning the present embodiment is configured to reserve a transmission of the diagnosis data to the management center 200, even if the microcomputer 12 receives a transmission request of the diagnosis data from the management center 200, for not causing a delay of the off-board diagnosis process in ECU 10.

Here, the diagnosis tool 50 is connected to the dedicated connector 40 is when performing the off-board diagnosis of the electronic control system. Therefore, the connection of the tool 50 to the connector 40 is usually only temporary (i.e., only for a short period of time). Therefore, in case that the diagnosis tool 50 is the only device that is connected to the dedicated connector 40, even if the transmission of the diagnosis data to the management center 200 is reserved for such a short period of time, it will not cause a problem in particular.

However, in recent years, various kinds of information, including the fuel mileage, an average speed, water temperature, etc., are read out by a display device that is sold publicly. The device is connected to the system via the dedicated connector 40, and such a display device is usually connected to the connector 40 all the time (i.e., for a long time). On the electronic control system side, it is difficult to distinguish whether the external device connected to the connector 40 is the diagnosis tool 50, or the publicly-sold display device. Therefore, simply prohibiting a transmission of the diagnosis data to the management center 200 in response to the transmission request when an external device is connected to the dedicated connector 40 will not work. That is, in such prohibition scheme, when the user connects the publicly-sold display device to the dedicated connector 40, the diagnosis data is not transmittable from the vehicle 100 to the management center 200 at all. In such case, the remote diagnosis service may not be provided for the user.

Therefore, in the electronic control system concerning the present embodiment, while IGSW 2 is turned ON, the requested transmission of the diagnosis data is reserved, and, after IGSW 2 is turned OFF, the requested transmission of the diagnosis data is performed.

In such manner, while IGSW 2 is turned ON, during which the off-board diagnosis is performed by the diagnosis tool 50 that is connected to the dedicated connector 40, a delay of the off-board diagnosis process in ECU 10 due to the transmission process of the diagnosis data is prevented.

Further, after IGSW 2 is turned OFF, even if the external device connected to the dedicated connector 40 is the diagnosis tool 50, ECU 10 is not required to respond to the request from the external device. Therefore, ECU 10 performs the requested transmission of the diagnosis data, after IGSW 2 is turned OFF. Thereby, the data required for the remote diagnosis service is transmittable to the management center 200.

Figure 2:
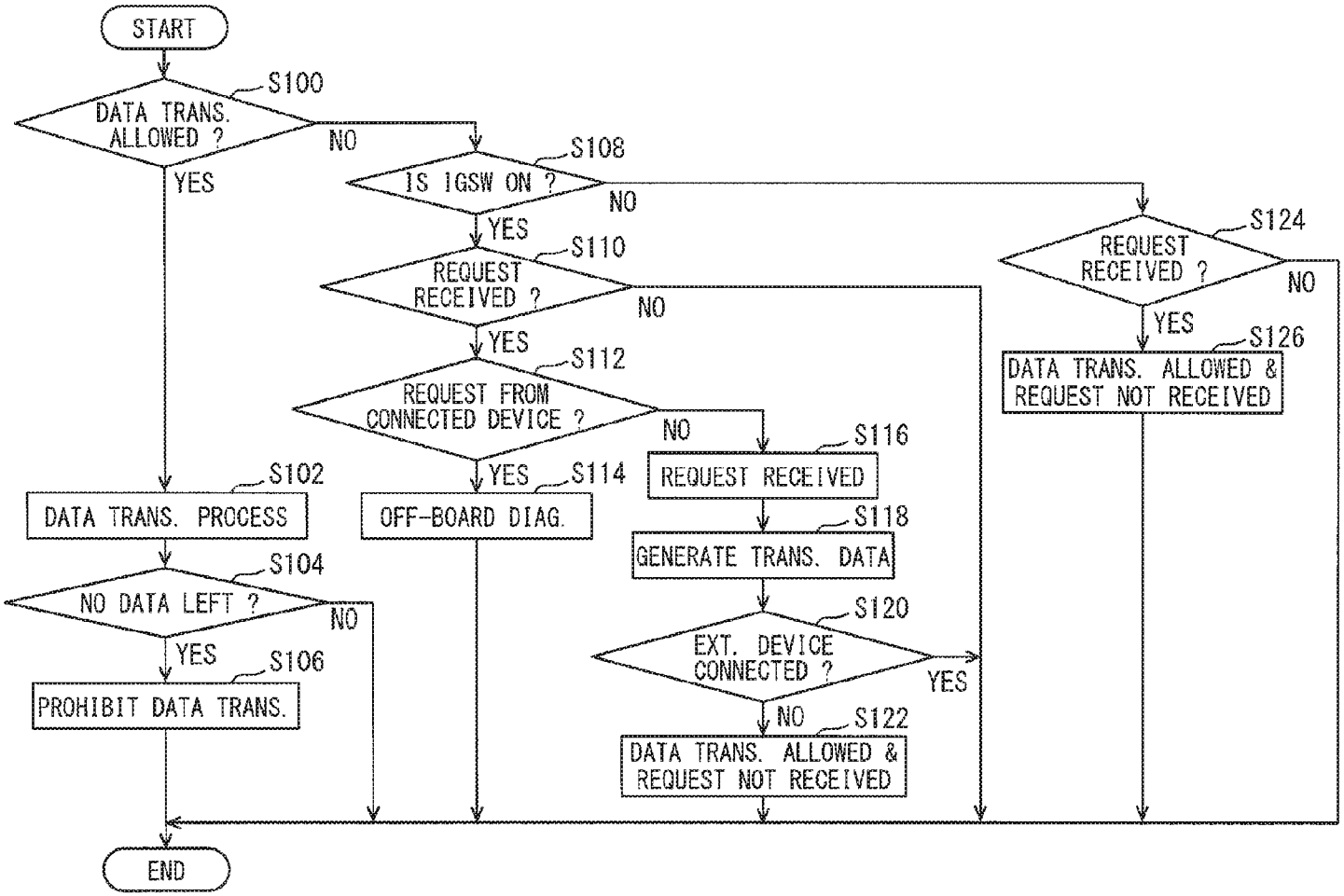
FIG. 2 is a flowchart of an arbitration process for arbitrating an off-board diagnosis process and a transmission process of diagnosis data in the electronic control system in the first embodiment of the present disclosure.

The process for arbitrating the off-board diagnosis process and the transmission process of the diagnosis data which are mentioned above is described with reference to a flowchart in FIG. 2. The process shown in the flowchart of FIG. 2 is repeatedly performed at predetermined intervals.

In Step S100, it is determined whether a data transmission flag which shows a permission or a prohibition of transmission of the diagnosis data to the management center 200 is set to "allowed."

When the data transmission flag is set to "allowed" (S100:YES), the process proceeds to Step S102, and when set to "prohibition" (S100:NO), the process proceeds to Step S108.

The data transmission flag has its initial value set to "prohibition."

In Step S102, since the data transmission flag is set to "allowed," a data transmission process is performed. That is, the microcomputer 12 outputs the diagnosis data requested from the management center 200 to the communication module 20, and transmits the diagnosis data to the management center 200 from the communication module 20. The diagnosis data transmitted to the management center 200 is generated at Step S118 mentioned later, and is saved in the memory of the microcomputer 12.

In Step S104, it is determined whether transmission of all diagnosis data which should be transmitted is complete. When it is determined that transmission of all diagnosis data is complete (S104:YES), the process proceeds to Step S106. On the other hand, when it is determined that the diagnosis data which should still be transmitted is left (S104:NO), the process of the flowchart in FIG. 2 is finished at once. In this case, when the process of the flowchart of FIG. 2 is performed next time, transmission of the untransmitted diagnosis data will be performed.

Then, in Step S106, since transmission of all diagnosis data is complete, the data transmission flag is changed to "prohibition" from "allowed."

In Step S108, which is performed when the data transmission flag is determined in Step S100 as "prohibition," it is determined whether IGSW 2 is set to ON based on the IG signal. When it is determined that IGSW 2 is ON (S108:YES), the process proceeds to Step S110. On the other hand, when it is determined that IGSW 2 is OFF (S108:NO), the process proceeds to Step S124.

In Step S110, it is determined whether a request from the external device connected to the dedicated connector 40 or from the management center 200 is received. When it is determined that a request is received (S110:YES), the process proceeds to Step S112, and, when it is determined that a request is not received (S110:NO), the process of the flowchart in FIG. 2 is finished at once.

In Step S112, it is determined whether the received request is coming from the external device connected to the dedicated connector 40. In this determination process, when it is determined that the received request is coming from the external device connected to the dedicated connector 40 (S112:YES), the process proceeds to Step S114. On the other hand, when it is determined that the received request is coming from the management center 200 (S112:NO), the process proceeds to Step S116.

In Step S114, an off-board diagnosis process is performed. That is, the failure diagnosis data is read out according to the request message from the external device or, while performing the special operation of the control object device, the operation-related data regarding the special operation is detected. Then, a response message that includes the data as well as a proof of execution of the requested diagnosis operation is transmitted back to the external device.

On the other hand, in Step S116, a request reception flag which shows that a transmission request of the diagnosis data from the management center 200 is received is set to "ON" (REQUEST RECEIVED). In Step S118, by either reading out the requested diagnosis data from the memory, or by detecting the data from the sensor, transmission data is generated.

In Step S120, it is determined whether the external device is connected to the dedicated connector 40. When it is determined that the external device is not connected to the dedicated connector 40 (S120:NO), the process proceeds to Step S122, and the data transmission flag is set to "allowed." By such setting, when the process of the flowchart in FIG. 2 is performed next time, the data transmission process will be performed.

In other words, a preparation of the transmission process in response to the transmission request from the management center 200 is complete by setting the data transmission flag to "allowed." This leads to the request reception flag being changed to the "NO" in Step S122.

On the other hand, in Step S120, when it is determined that the external device is connected to the dedicated connector 40, the process of the flowchart in FIG. 2 is finished at once without performing any other step.

According to the present embodiment, as mentioned above, when IGSW 2 is turned ON and the external device is connected to the dedicated connector 40, even when the transmission request from the management center 200 is received, transmission of the diagnosis data is not performed.

Therefore, when the external device connected to the dedicated connector 40 is the diagnosis tool 50 and the off-board diagnosis is performed, a delay of the off-board diagnosis process is prevented.

On the other hand, since there is no possibility of causing a delay of the off-board diagnosis when the external device is not connected to the dedicated connector 40, ECU 10 immediately performs the transmission process, (i.e., by generating the transmission data (Step S118) and by allowing the data transmission (Step S122)).

In Step S124, which is performed when IGSW 2 is determined to be OFF in Step S108, it is determined whether the request reception flag is set to "ON" (i.e., REQUEST RECEIVED). In this determination process, if it is determined that the request reception flag is set to "ON" (S124:YES), the process proceeds to Step S126.

In Step S126, while setting the data transmission flag to "allowed," the request reception flag is changed to "NO". By such setting, when the process of the flowchart in FIG. 2 is performed next time, the data transmission process will be performed.

As mentioned above, after IGSW 2 is turned OFF, the power supply to ECU 10 and the communication module 20 is continued for a predetermined time, for enabling an operation of both the ECU 10 and the communication module 20. Further, in the present embodiment, in case that the data transmission is reserved under a condition that, the transmission request of the diagnosis data is received from the management center 200 when IGSW 2 is turned ON, and the external device is connected to the dedicated connector 40, ECU 10 performs the transmission process. The transmission process is triggered by a turning OFF of IGSW 2, after the process of Step S124 and Step S126. Thereby, even when a commercial display device is always connected to the dedicated connector 40, the data required for the remote diagnosis service is transmittable to the management center 200.

Second Embodiment

Next, the second embodiment of the present disclosure is described. Since the configuration of the electronic control system in the second embodiment is the same as the one in the first embodiment, the description of the configuration is not provided.

In the first embodiment mentioned above, when the transmission request from the management center 200 is received, the transmission data generation process is performed in Step S118.

Figure 3:
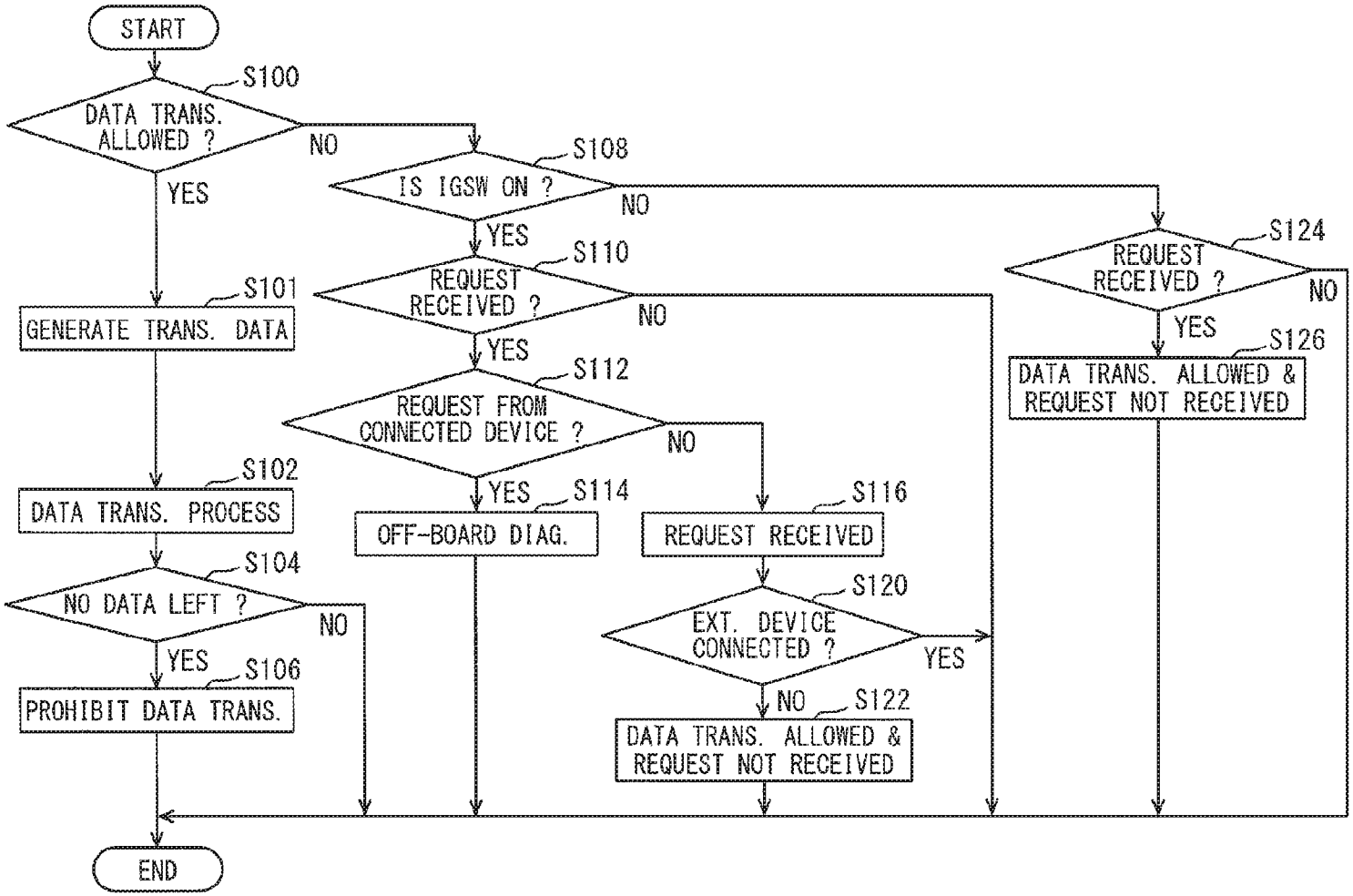
FIG. 3 is a flowchart of the arbitration process for arbitrating the off-board diagnosis process and the transmission process of the diagnosis data in a second embodiment of the present disclosure.

However, as shown in Step S101 of the flowchart in FIG. 3, the transmission data generation process may be performed just before the data transmission process of S102. The other parts of the flowchart in FIG. 3 are the same as that of the flowchart in FIG. 2.

By performing the transmission data generation process just before the data transmission process as described above, a process load of ECU 10 in a situation when the external device is connected to the dedicated connector 40 and IGSW 2 is turned ON is further lightened. Therefore, when the off-board diagnosis is performed by the diagnosis tool 50, a delay of the off-board diagnosis process in ECU 10 is more securely prevented.

Third Embodiment

Next, the third embodiment of the present disclosure is described. Since the configuration of the electronic control system in the third embodiment is the same as the one in the first embodiment, the description of the configuration is not provided.

In the first embodiment mentioned above, when the microcomputer 2 detects that IGSW 2 is turned OFF based on an input of the IG signal, the microcomputer 12 instructs the power supply IC 11 to output the low-level signal after a preset time. However, as shown in a flowchart in FIG. 4, in Step S128, the microcomputer 2 may instruct the power supply IC 11 to stop the power supply (i.e., may instruct the IC 11 to perform a power shut down process).

Figure 4:
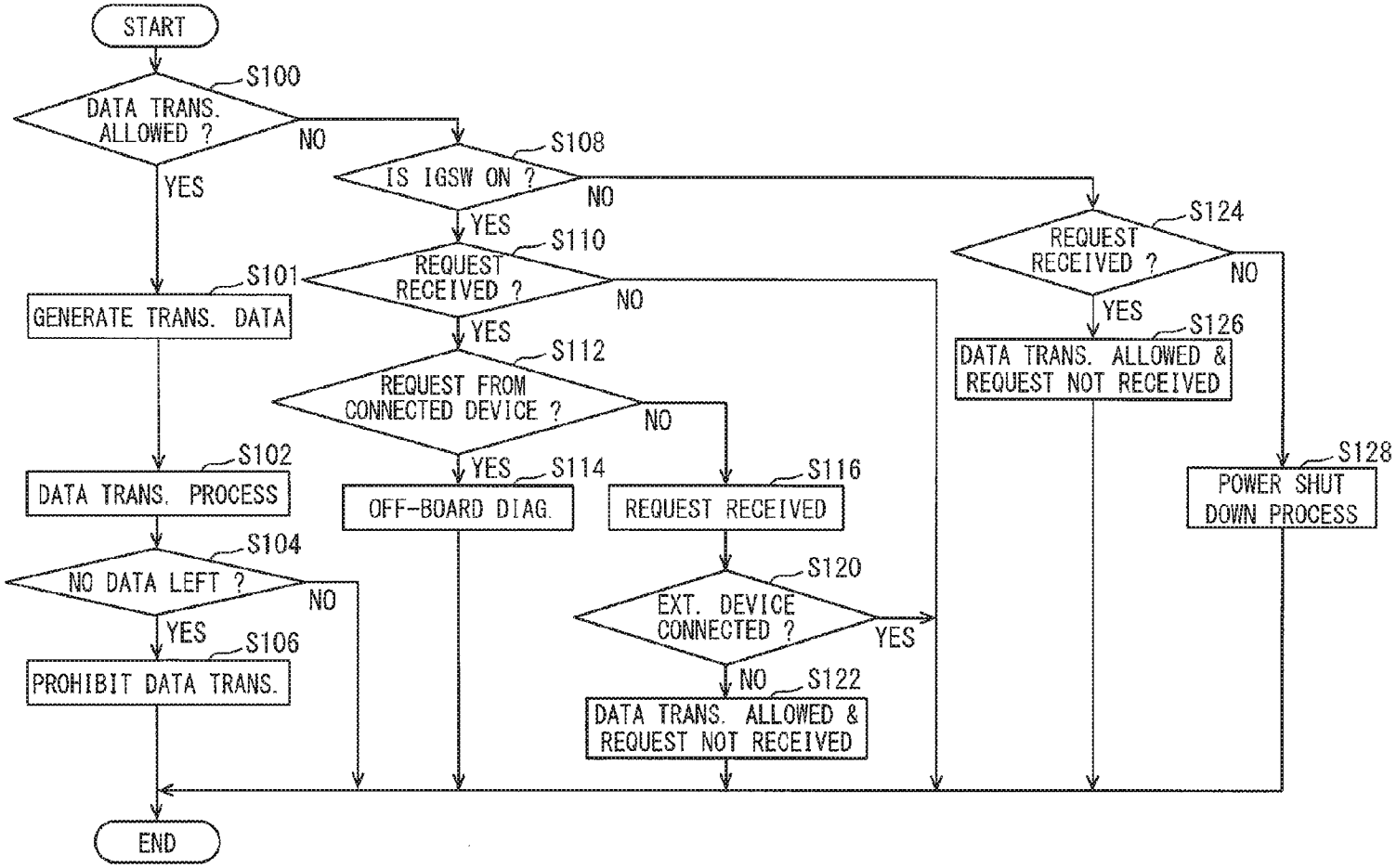
FIG. 4 is a flowchart of the arbitration process for arbitrating the off-board diagnosis process and the transmission process of the diagnosis data in a third embodiment of the present disclosure.

In Step S124 of the flowchart in FIG. 4, when it is determined that the request reception flag is set to "OFF" (S124:NO), the "OFF" setting of the flag is interpreted either as (i) a no request received state (i.e., no request from the center 200) or (ii) in case that a transmission request has been received, a transmission complete state (i.e., data transmission to the center 200 is already complete).

Therefore, in Step S124, when (i) it is determined that the request reception flag is set to "OFF" (S124:NO), if there is no need to perform the data transmission, the power supply is stopped immediately after a turning OFF of IGSW 2 by an execution of the power shut down process in S128. Further, even in case that the data transmission is required after a turning OFF of IGSW 2, once such data transmission is complete, the power supply is stopped without delay. Therefore, unnecessary power consumption is reduced.

Fourth Embodiment

Next, the fourth embodiment of the present disclosure is described. Since the configuration of the electronic control system in the fourth embodiment is the same as the one in the first embodiment, the description of the configuration is not provided.

In the first embodiment mentioned above, when the data transmission request from the management center 200 is received, it is determined whether the external device is connected to the dedicated connector 40 (S120). If it is determined that the device is connected to the connector 40, transmission of the requested diagnosis data is reserved until IGSW 2 is turned OFF.

However, if connection of the external device to the dedicated connector 40 is released (i.e., disconnection of the external device from the connector) before IGSW 2 is turned OFF, there is no problem for generation and transmission of the diagnosis data.

Figure 5:
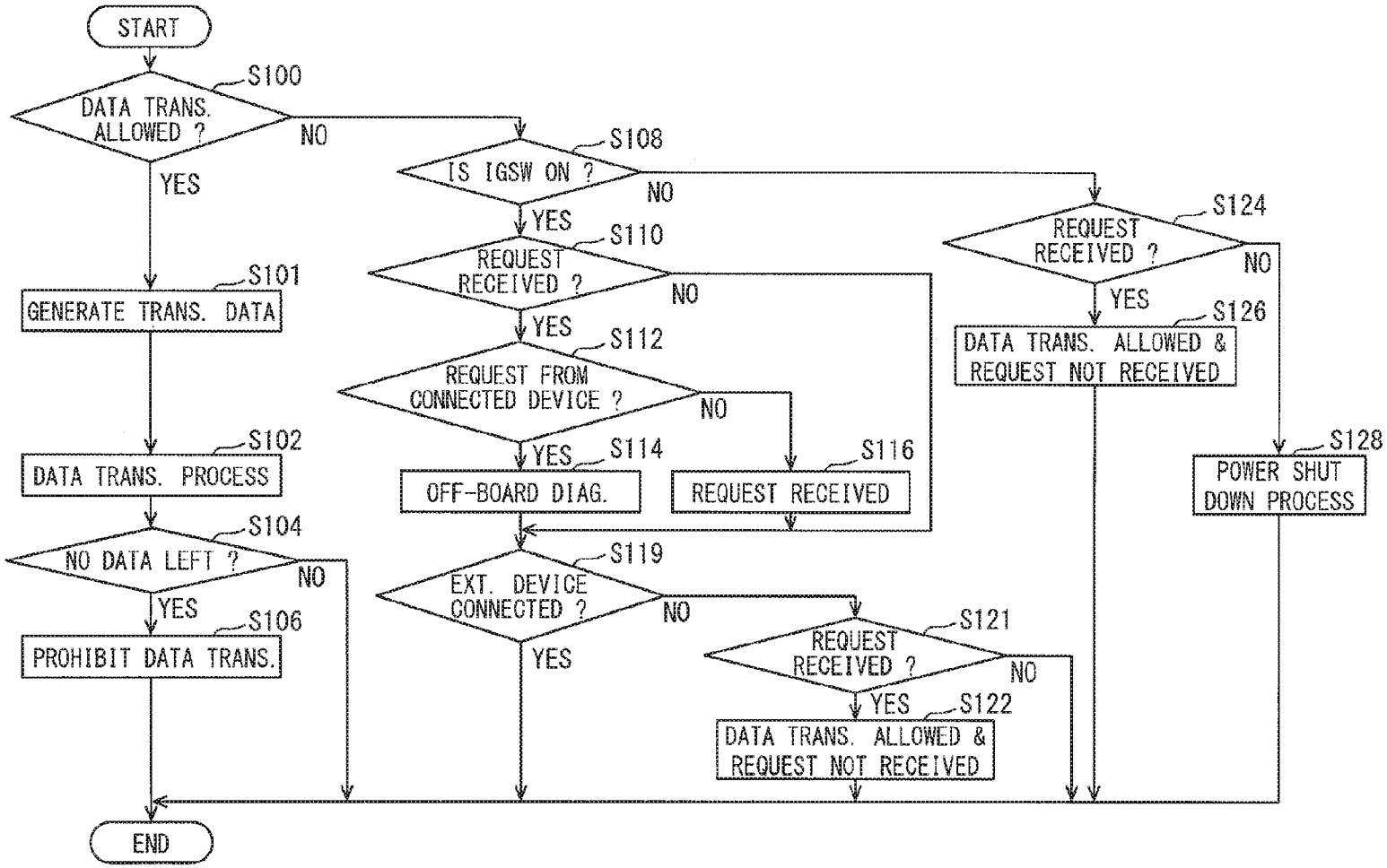
FIG. 5 is a flowchart of the arbitration process for arbitrating the off-board diagnosis process and the transmission process of the diagnosis data in a fourth embodiment of the present disclosure.

Therefore, without regard to (i) the determination result of S110 (i.e., whether a request from the connected device or from the center 200 is received), or (ii) the determination result of S112 (i.e., whether the request is from the connected device), it is always determined as shown in Step S119 of the flowchart in FIG. 5 whether the external device is connected to the dedicated connector 40 when IGSW 2 is turned ON. In such manner, after the end of the off-board diagnosis by the diagnosis tool 50 and the disconnection of the diagnosis tool 50 from the dedicated connector 40, for example, the requested diagnosis data is immediately transmittable to the management center 200.

Fifth Embodiment

Next, the fifth embodiment of the present disclosure is described. Since the configuration of the electronic control system in the fifth embodiment is the same as the one in the first embodiment, the description of the configuration is not provided.

In the first embodiment mentioned above, whether the external device is connected to the dedicated connector 40 is detected by a mechanical switch in the dedicated connector 40. However, it is possible to detect whether the device is connected to the connector 40 without using the mechanical switch.

Figure 6:
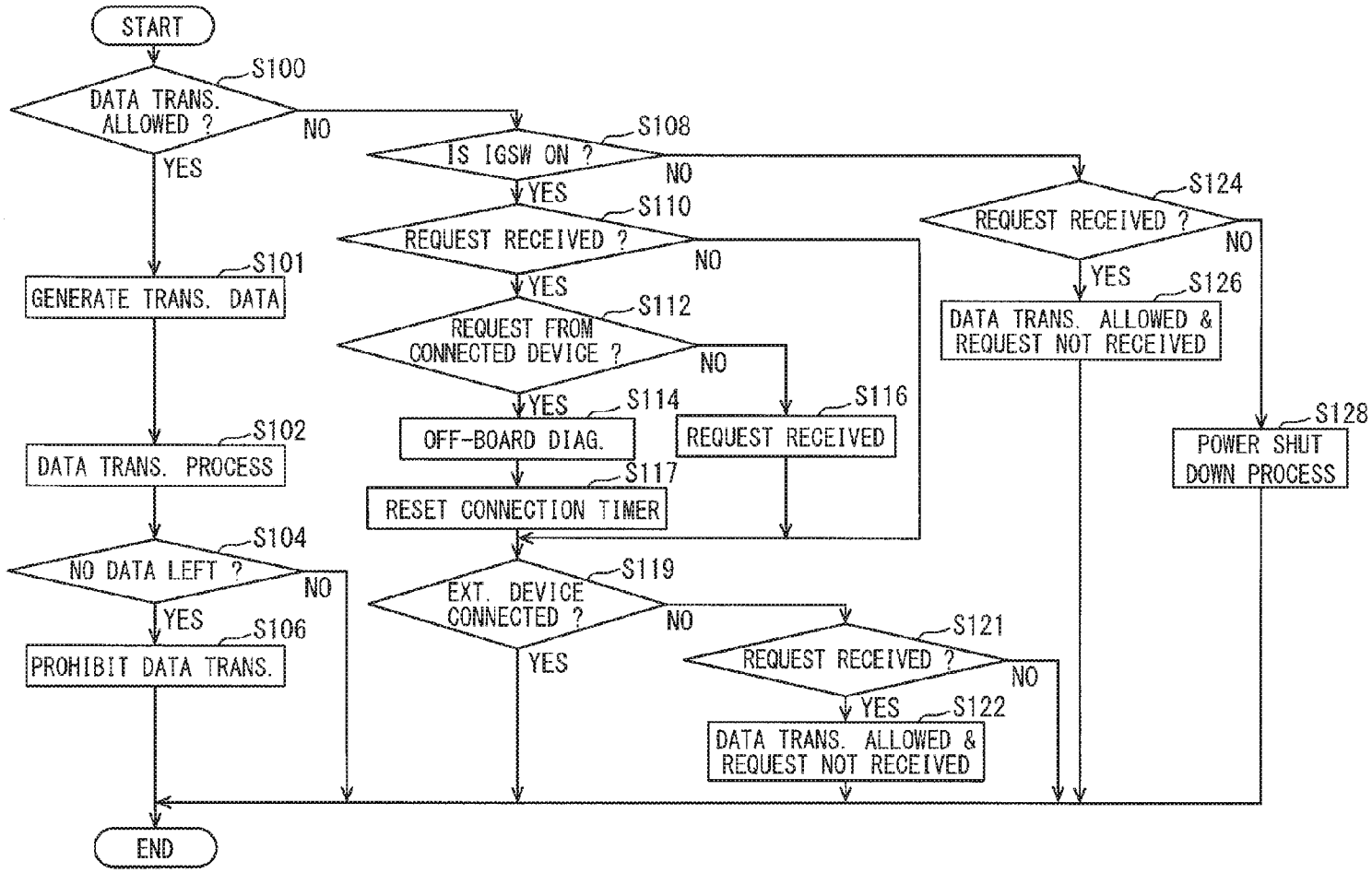
FIG. 6 is a flowchart of the arbitration process for arbitrating the off-board diagnosis process and the transmission process of the diagnosis data in a fifth embodiment of the present disclosure.

For example, as shown in Step S117 of the flowchart in FIG. 6, a connector connection timer may be provided, which is reset to zero when the request from the external device connected to the dedicated connector 40 is received. Based on the predetermined time of measurement by such timer (e.g., 30 seconds), such an event may be detected as a release of the connection of the external device to the connector 40 (i.e., disconnection of the external device from the connector 40).

Although the present disclosure has been described in connection with preferred embodiment thereof with reference to the accompanying drawings, it is to be noted that various changes and modifications will become apparent to those skilled in the art, and such changes, modifications, and summarized schemes are to be understood as being within the scope of the present disclosure as defined by the appended claims.

What is claimed is:

1. An electronic control device installed in a vehicle configured to control a transmission of vehicle diagnostic data to an external vehicle data management center, the electronic control device comprising:

a microcomputer configured to interface with vehicle sensors to accumulate vehicle diagnostic data from the vehicle sensors and actuators and to store the vehicle diagnostic data into a memory in response to a diagnostic request signal from an external diagnostic device, wherein the microcomputer is further configured to detect an ON state and an OFF state of a vehicle ignition switch and detect a vehicle diagnostic data transmission request from the external vehicle data management center, in response to the microcomputer detecting the vehicle diagnostic data transmission request, transmit the vehicle diagnostic data stored in the memory to a vehicle communication module, and wherein the microcomputer is in connection with a dedicated connector within the vehicle, the dedicated connector is configured to connect to the external diagnostic device or another external device, the microcomputer is further configured to detect a connection of the external diagnostic device or the other external device to the dedicated connector, and in response to the microcomputer detecting the vehicle diagnostic data transmission request and the connection of the external diagnostic device or the other external device to the dedicated connector, the microcomputer transmits the vehicle diagnostic data stored in the memory to the vehicle communication module when the microcomputer detects the OFF state of the vehicle ignition switch.

2. The electronic control device of claim 1, further comprising:

a power supply integrated circuit (IC) connected to the microcomputer and configured to receive an instruction from the microcomputer to output either a high-level signal or a low-level signal;

a logic gate connected to the power supply IC and the vehicle ignition switch and configured to receive either an ignition signal when the vehicle ignition switch is in the ON state or the high-level signal from the power supply IC, and to output a high-level signal in response to receiving either the ignition signal or the high-level signal from the power supply IC; and a transistor connected to the logic gate and configured to actuate a relay to provide power from a vehicle battery to the microcomputer in response to receiving the high-level signal from the logic gate, wherein the microcomputer is further configured to in response to the microcomputer detecting the OFF state of the vehicle ignition switch, instruct the power supply IC to output the high-level signal to the transistor for a preset period of time.

3. The electronic control device of claim 1, wherein the microcomputer is further configured to detect a disconnection of the external diagnostic device or the other external device from the dedicated connector, and in response to the microcomputer detecting the vehicle diagnostic data transmission request and the disconnection of the external diagnostic device or the other external device from the dedicated connector, transmit the vehicle diagnostic data stored in the memory to the vehicle communication module when the vehicle ignition switch is in the ON state.

4. The electronic control device of claim 3, wherein the microcomputer is further configured to in response to the diagnostic request signal from the external diagnostic device, wait a preset amount of time before detecting the disconnection of the external diagnostic device or the other external device from the dedicated connector.

5. An electronic control system configured to control a transmission of vehicle diagnostic data to an external vehicle data management center, the system comprising:

a microcomputer configured to interface with vehicle sensors and actuators, to accumulate vehicle diagnostic data from the vehicle sensors and actuators and to store the vehicle diagnostic data from the vehicle sensors and actuators into a memory in response to a diagnostic request signal from an external diagnostic device;

a vehicle communication module in connection with the microcontroller, the vehicle communication module is configured to receive a vehicle diagnostic data transmission request from the external vehicle data management center, to transmit the vehicle diagnostic data transmission request to the microcomputer, to receive the vehicle diagnostic data from the microcomputer, and to transmit the vehicle diagnostic data to the external vehicle data management center; and a dedicated connector within the vehicle in connection with the microcomputer, the dedicated connector configured to connect to the external diagnostic device or another external device, the microcomputer is further configured to detect both an ON state and an OFF state of a vehicle ignition switch, and in response to the microcomputer receiving the vehicle diagnostic data transmission request from the vehicle communication module and detecting the OFF state of the vehicle ignition switch, transmit the vehicle diagnostic data stored in the memory to the vehicle communication module and the vehicle communication module transmits the vehicle diagnostic data to the external vehicle data management center, and wherein the microcomputer is further configured to detect a connection of the external diagnostic device or the other external device to the dedicated connector, in response to the microcomputer receiving the vehicle diagnostic data transmission request from the vehicle communication module and detecting the connection of the external diagnostic device or the other external device to the dedicated connector, the microcomputer transmits the vehicle diagnostic data stored in the memory to the vehicle communication module and the vehicle communication module transmits the vehicle diagnostic data to the external vehicle data management center when the vehicle ignition switch is in the OFF state.

6. The electronic control system of claim 5 further comprising:

a power supply integrated circuit (IC) connected to the microcomputer and configured to receive an instruction from the microcomputer to output either a high-level signal or a low-level signal;

a logic gate connected to the power supply IC and the vehicle ignition switch and configured to receive either an ignition signal when the vehicle ignition switch is in the ON state or the high-level signal from the power supply IC, and to output a high-level signal in response to receiving either the ignition signal or the high-level signal from the power supply IC; and a transistor connected to the logic gate and configured to actuate a relay to provide power from a vehicle battery to the microcomputer and the vehicle communication module in response to receiving the high-level signal from the logic gate, wherein the microcomputer is further configured to in response to the microcomputer detecting the OFF state of the vehicle ignition switch, instruct the power supply IC to output the high-level signal for a preset period of time, and after the preset period of time lapses instruct the power supply IC to output the low-level signal.

7. The electronic control system of claim 5 wherein the microcomputer is further configured to detect a disconnection of the external diagnostic device or the other external device from the dedicated connector, and in response to the microcomputer receiving the vehicle diagnostic data transmission request from the vehicle communication module and detecting the disconnection of the external diagnostic device or the other external device from the dedicated connector, transmit the vehicle diagnostic data stored in the memory to the vehicle communication module for transmission to the external vehicle data management center when the vehicle ignition switch is in the ON state.

8. The electronic control system of claim 7, wherein the microcomputer is further configured to in response to the diagnostic request signal from the external diagnostic device, wait a preset amount of time before detecting the disconnection of the external diagnostic device or the other external device from the dedicated connector.

* * * * *